US005812098A

United States Patent [19]

Harris et al.

[11] Patent Number: 5,812,098

[45] Date of Patent: Sep. 22, 1998

[54] RETRACTABLE ANTENNA CONNECTOR ASSEMBLY SYSTEM AND METHOD

[75] Inventors: Rick Dale Harris; Tai Won Youn; Jagtar Singh Saroya, all of Vancouver, Wash.

[73] Assignees: Sharp Microelectronics Technology, Inc., Camas, Wash.; Sharp Kabushiki Kaisha, Osaka, Japan

[21] Appl. No.: 756,783

[22] Filed: Nov. 26, 1996

[51] Int. Cl.[6] ..... H01Q 1/24; H01Q 1/50

[52] U.S. Cl. ..... 343/906; 343/702; 343/916

[58] Field of Search ..... 343/906, 702, 343/901; 439/916, 912, 578, 585; H01Q 1/24, 1/50

[56] References Cited

U.S. PATENT DOCUMENTS

| | | | |
|---|---|---|---|
| 4,611,213 | 9/1986 | Johnson et al. | 343/906 |
| 4,867,698 | 9/1989 | Griffiths | 343/906 |
| 5,158,483 | 10/1992 | Fishman et al. | 439/668 |
| 5,218,369 | 6/1993 | Jennings | 343/702 |
| 5,551,080 | 8/1996 | Chambers et al. | 455/348 |
| 5,616,043 | 4/1997 | Liou | 343/906 |

*Primary Examiner*—Hoanganh T. Le

*Attorney, Agent, or Firm*—Gerald Maliszewski; David Ripma

[57] ABSTRACT

A single port antenna connector assembly, mateable with either a retractable antenna or a hardline connector, is provided. When the antenna connector is mated with the connector assembly, it engages a signal contact supplying an antenna signal. When the hardline connector is mated, it engages a signal contact supplying a conductive signal to test equipment, or to an auxiliary antenna. The signal contacts have different positions in the assembly, with each connector being differentiated to engage only its corresponding signal contact. In addition, the design of connector assembly permits the antenna to be withdrawn through the connector assembly, at least partially, past the unused test signal contact. The antenna has at least two positions so that the profile of the antenna can be reduced for either storage, or for lower gain operation when the device is in a standby mode of operation. A method for selecting a retractable antenna connector assembly signal contact in response to the connector type mated to the assembly is also provided.

25 Claims, 8 Drawing Sheets

Fig. 7
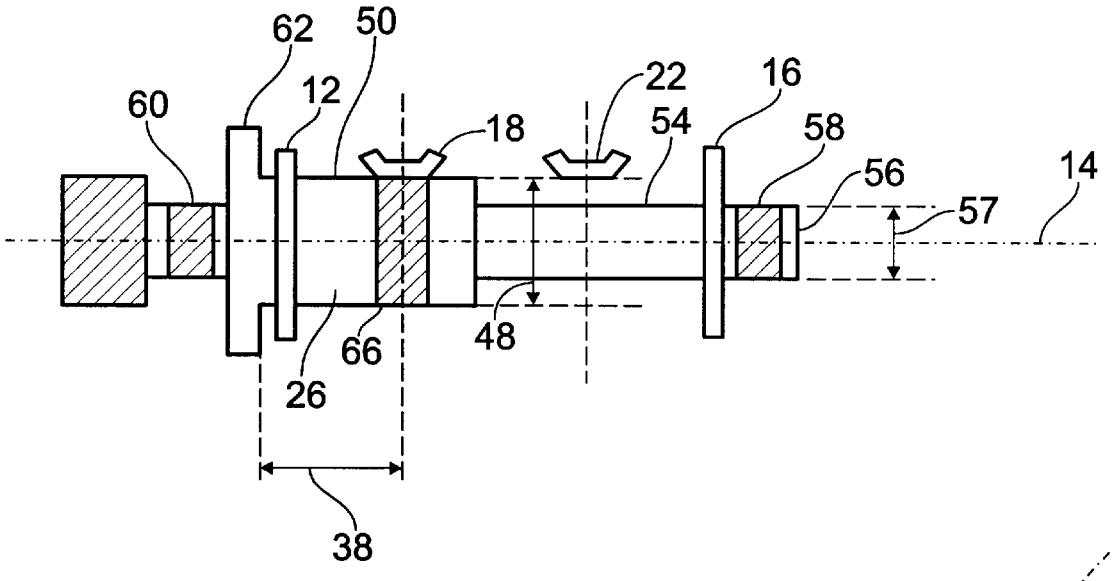
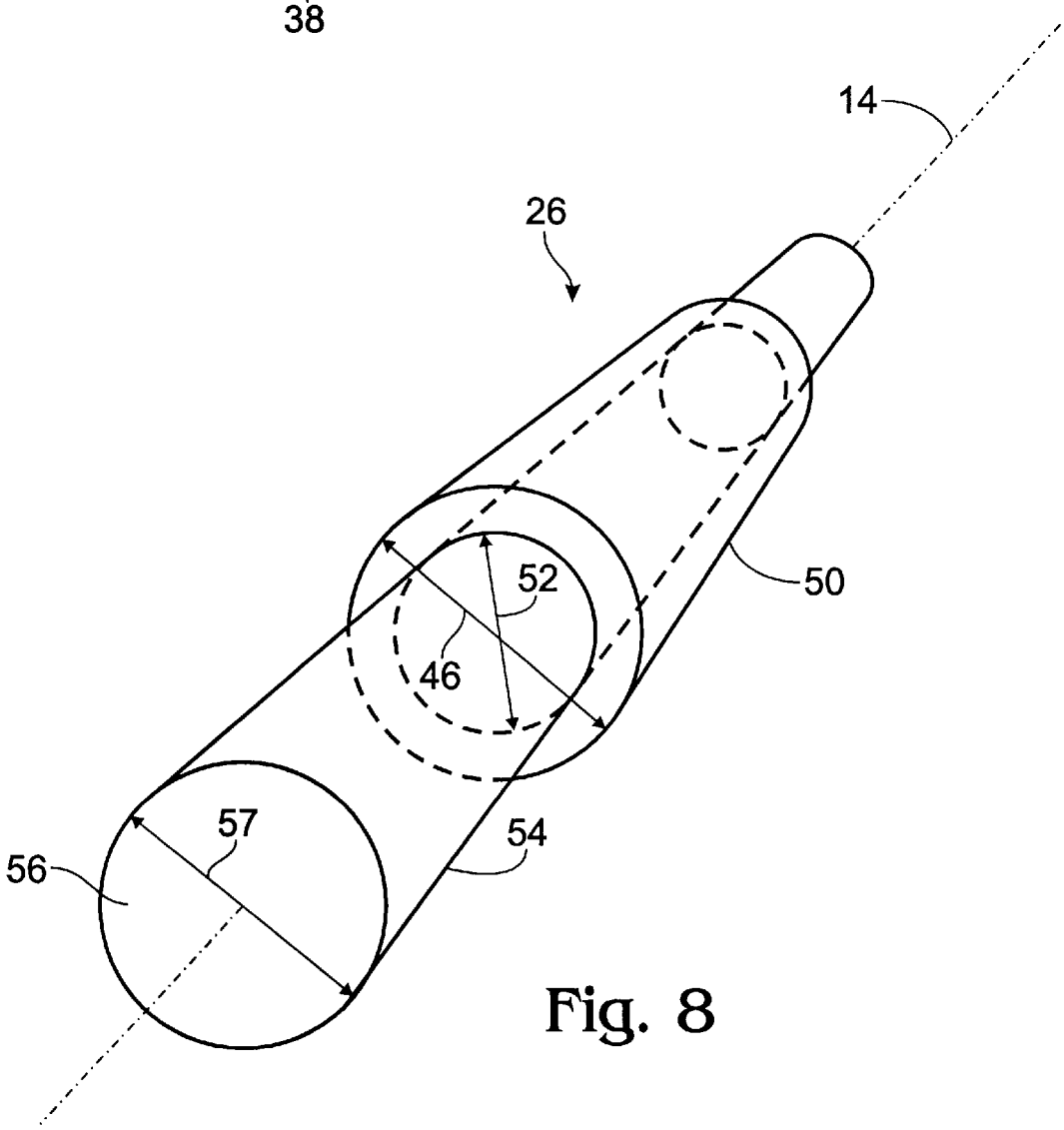
Fig. 8

RETRACTABLE ANTENNA CONNECTOR ASSEMBLY SYSTEM AND METHOD

BACKGROUND AND SUMMARY OF THE INVENTION

This invention relates generally to an antenna connector assembly, and more particularly, to a connector assembly system and method selectively engageable to either a retractable antenna or a hardline connector.

Wireless communications devices, including radios, radio transceivers, radio telephones, cellular telephones, or the like, communicate over an airlink using antennas. In the manufacture or repair of radio transceivers it is important to know if the transmitter power and receiver sensitivity meet specifications. It is desirable that these, and other, performance parameters of individual units are sampled or tested. Airlink testing of radios does not permit the accurate measurement of transmitter power or receiver sensitivity in production testing. Neither can the interface impedances of the transmitter and receiver circuits be measured when connected to an antenna. Therefore, fully assembled radios might not tested for these fundamental performance characteristics. Testing is typically done at a sub-assembly level, with some disassembly of the radio, or over an airlink.

To test transmitter power, receiver sensitivity, or circuit impedances in radio frequency (RF) communications equipment, a cable or hardwire connection is usually necessary. A hardwire connection from the communications equipment to external test measurement devices is made convenient with the use of a test port on the communications device. Typically, a connector is used to mate with the test port. A suitable commercial connector for this purpose will have controlled performance specifications such as SMA, BNC, TNC, or the like, type connectors. These connector types permit a quick connection of test equipment to the test port, and repeatable measurements. The impedance of such test ports is a matter of design choice and preferably matches industry standard, 50 ohm, test equipment. Test equipment attached to a test port having a matching impedance with a known insertion loss, permits quick, simple, and accurate measurement of transmitter power, receiver sensitivity, or circuit interface impedances.

It is desirable, therefore, to build radios having the above mentioned test ports. However, the cost of a test port switch, connector, associated parts, and additional labor must be added to the total cost of the product. In addition, these parts require space which is a valuable commodity in small portable units.

The addition of a test port to a radio raises other problems related to manufacturing test and radio performance. Antennas are typically mounted on the top of the radio case for maximum antenna gain and user convenience. For ease of manufacturing test, a test port is preferably mounted on the bottom of the case where other external radio connectors are typically found. For the same reason, it is also convenient to mount a test port switch at the bottom of the case. However, the amount of cable needed to connect the radio's antenna interconnect to the switch at the bottom of the case, and then connect the switch to the antenna at the top of the case, degrades radio performance by adding insertion loss in the path between the radio's antenna interconnect and the antenna.

The problem of building a portable radio with both a test port and an antenna is further compounded by the fact that commercially available antennas do not, typically, have an impedance of 50 ohms. A radio with a 50 ohm test port is relatively easy to make, once a 50 ohm antenna and a radio frequency (RF) switch are provided. The output of the radio can be switched to either the antenna or the test port. Since all the impedances are 50 ohms, impedance matching issues are resolved. However, the RF switch adds at least some insertion loss in the path between the radio's antenna interconnect and the antenna. In addition, 50 ohm antennas are non-standard and, therefore, costly. RF switches are also relatively costly. Finally, the RF switch is preferably controlled by the connection of an external device to the test port. If the switch is enabled by the connection of an external device to the test port, the test port, switch, and antenna must be located near each other, which is inconvenient for factory test.

Jennings, U.S. Pat. No. 5,218,369, discloses a quick release antenna port. Using this device, an external antenna can be quickly disengaged, when a test connector is engaged with the wireless device through another connector port. However, two ports are still required. In addition, both the antenna port and the test port must be designed to have the same impedance, or alternately, the design must include switches and matching networks which add to the insertion loss in the interface to one or both of the ports. The additional port connector and associated parts also increase the cost of the unit.

Fishman, et al., U.S. Pat. No. 5,158,483, discloses a single port antenna connector assembly that also accepts a test connector, when the antenna is not engaged. Although the single port connector assembly disclosed accepts two different styles of connectors, the design still requires a switch to disconnect the antenna contact when the test port contact is engaged. More importantly, the disclosed connector assembly does not allow the antenna to be retracted for storage, or standby operation, as is desirable in most portable wireless applications.

A co-pending application, Ser. No. 08/546,175, filed Oct. 20, 1995, entitled "Radio Transceiver with Impedance Matched Test Port", invented by Douglas J. Milar, Tatsuya Uetake and Tai Won Youn, Attorney Docket Number SMT 145, which is assigned to the same assignee as the instant patent, discloses a two port connector assembly which switches out the antenna matching network when the test port is engaged. Although the design allows for a rapid antenna disconnect during test and minimizes insertion loss, two ports are still required and at least some insertion loss exists due to a switch and length of line between the matching network and the test port.

It would be advantageous if a single port connector assembly could be configured to communicate either a conducted signal to test a wireless device, or a radiated signal through an antenna for communications, in response to the interfacing connector used.

It would be advantageous if a single port connector assembly could be configured to selectively communicate either different types electrical signals, or the same signal at different impedances. It would also be advantageous if the selection of signals was made in response to the mating connector engaged to the connector assembly.

It would also be advantageous if an antenna engaged to a single port selective signal connector assembly system could be retracted for storage, or low gain standby operation, by extending the antenna through the connector assembly body, past the signal contacts not in use.

Accordingly, an electrical connector assembly selectively engageable with mating connectors along a common insertion axis is provided. The connector assembly comprises a connector assembly body into which mating connectors are inserted, the body includes an insertion opening through which the insertion axis passes. The body includes a retraction opening at the end opposite the insertion opening along the insertion axis to permit passage of a mating connector member through the connector assembly body. The connector assembly also comprises a first contact positioned adjacent a first location along the insertion axis in the connector assembly body between the insertion opening and the retraction opening. An antenna connector is insertable into the insertion opening along the insertion axis to electrically interface with the first contact, whereby an antenna is operatively coupled to the connector assembly. The connector assembly also comprises a second contact positioned adjacent a second location in the connector assembly body along the insertion axis between the insertion opening and the retraction opening. A second mating connector is insertable into the insertion opening along the insertion axis to interface with the second contact, whereby the second mating connector is insertable into the insertion opening when the antenna connector is removed. The antenna connector includes an antenna member elongated along an axis selectively extendible into the insertion opening, through the body, and out of the retraction opening, whereby the antenna connector passes through the body for storage.

The antenna elongated member has a distal end slideably moveable along the insertion axis, out the retraction opening. The antenna connector has a first, high gain, position when the antenna distal end is minimally inserted into the insertion opening to interface the first contact. The antenna connector has a second, low gain, position when the antenna distal end is maximally inserted into the insertion opening, through the body, and out of the retraction opening, for optimal portability, whereby the antenna is moveable to communicate radiated signals in a plurality of antenna positions.

The distance along the insertion axis between the insertion opening and the first contact location is a first distance, and the distance between the insertion opening and the second contact location is a second distance, greater than the first distance, whereby the first and second contacts are selected by controlling the depth to which a mating connector is inserted into the insertion opening.

The second mating connector also includes a member elongated along an axis, and each mating connector has a first diameter around the axis of each elongated member to interface with the contacts. The contacts are located along a perimeter having a second diameter around the insertion axis, with the second diameter being less than or equal to the first diameter, whereby the pressure of each mating connector member against its respective connector assembly contact insures reliable electrical and mechanical connections.

Preferably, the antenna mating connector includes a first elongated member having an opening through which the first member axis passes, the first member opening having a third diameter around the axis of the first member, with the third diameter being less than the second diameter. The first member has a first diameter around the axis of the first member to interface with the first contact. The antenna connector also includes a second elongated member, with a distal end, having approximately a third diameter around the axis of the second member. The second member is extendible through the first member opening to operatively interface with the first contact through the first member, whereby the second member distal end is extendible past the second contact, through the body, and out the retraction opening, without the second member interfacing with the second contact.

A method is also provided for selectively communicating electrical signals from a connector assembly having two signal contacts in a connector assembly body. The body includes an insertion opening, through which the insertion axis passes, to allow access to the signal contacts from an antenna mating connector having a member elongated along an axis, and a test lead mating connector having a member elongated along an axis. The body also includes a retraction opening at the end opposite the insertion opening along the insertion axis to allow the passage of a connector member extending through the body.

The method includes the steps of: when the antenna connector is mated to communicate a radiated signal, inserting the antenna connector elongated member through the insertion opening to interface with a first signal contact adjacent a first location along the insertion axis between the insertion opening and the retraction opening; and, when the test lead connector is mated to conduct a signal, inserting the test lead connector elongated member through the insertion opening to interface with a second signal contact adjacent a second location along the insertion axis between the insertion opening and the retraction opening, whereby the selection of a mating connector determines which signal contact is interfaced.

BRIEF DESCRIPTION OF THE DRAWINGS

FIG. 7 illustrates the antenna connector including a first elongated member having an opening through which the axis of the first member passes.

FIG. 8 illustrates a perspective view of the antenna connector of FIG. 7.

DETAILED DESCRIPTION OF THE PREFERRED EMBODIMENT

FIGS. 1 through 8 illustrate an electrical connector assembly selectively engageable with mating connectors along a common insertion axis. The connector assembly is typically associated with a portable wireless device requiring a retractable antenna. Alternately, FIGS. 1–8 illustrate a connector assembly to engage a first and second connector, where the first connector is retractable into the body of the connector assembly.

Figure 1:
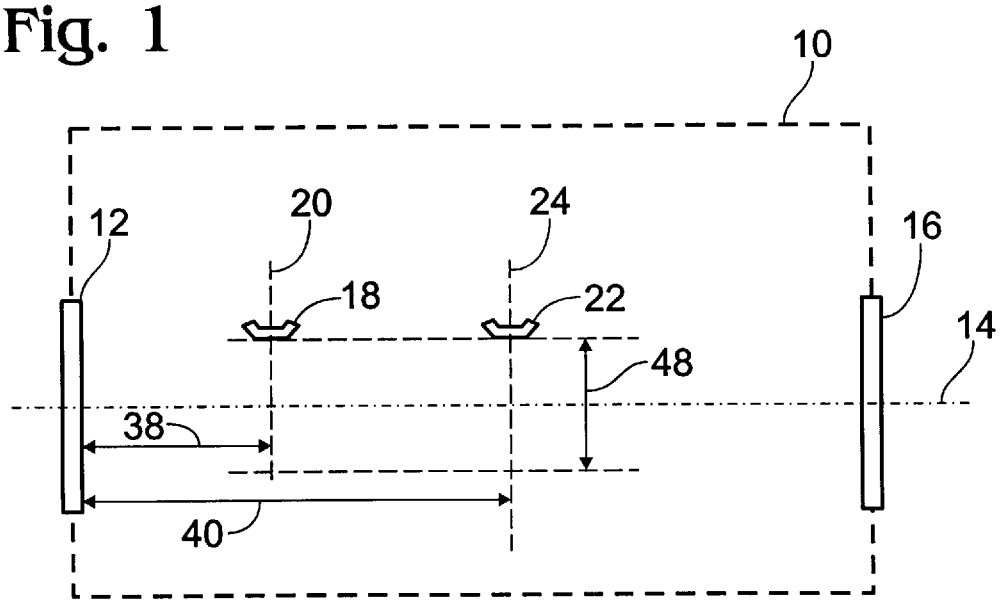
FIG. 1 illustrates a connector assembly body into which mating connectors are inserted.

FIG. 1 illustrates a connector assembly body 10 into which mating connectors (not shown) are inserted. Body 10 includes an insertion opening 12 through which an insertion axis 14 passes. Body 10 includes a retraction opening 16 at the end opposite insertion opening 12 along insertion axis 14 to permit passage of a mating connector member through connector assembly body 10.

A first contact 18 is positioned adjacent a first location 20 along insertion axis 14 in connector assembly body 10 between insertion opening 12 and retraction opening 16. A second contact 22 is positioned adjacent a second location 24 in connector assembly body 10 along insertion axis 14 between insertion opening 12 and retraction opening 16. First location 20 is positioned closer to insertion opening 12 than second location 24.

Figure 2:
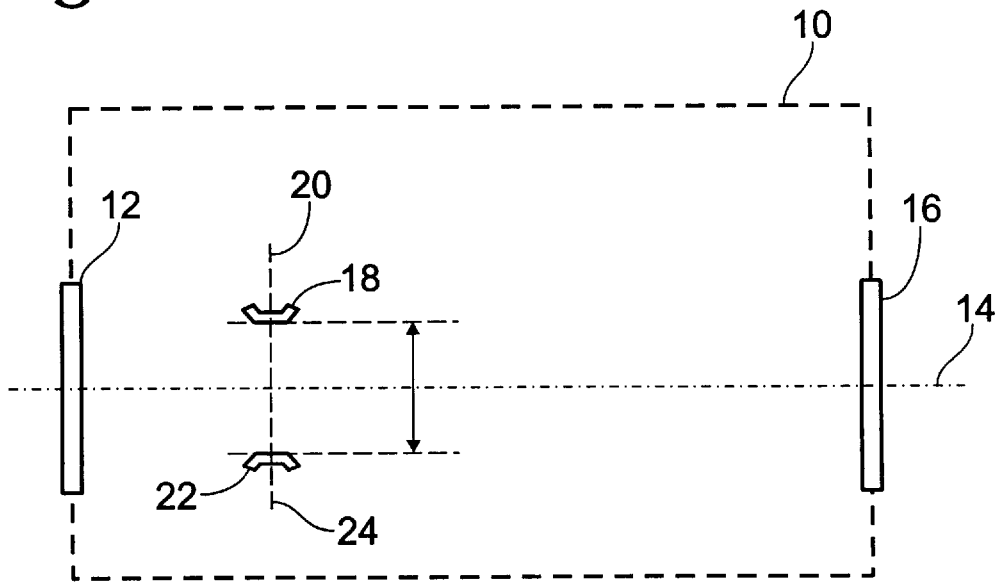
FIG. 2 illustrates an alternate arrangement of the contacts of FIG. 1.

FIG. 2 illustrates an alternate arrangement of contacts 18 and 22 of FIG. 1. First location 20 and second location 24 are the same distance from insertion opening 12, but first contact 18 and second contact 22 are at different locations along a perimeter having a diameter centered around insertion axis 14. That is, contacts 18 and 22 are selected in FIG. 1 by controlling the penetration depth of a connector into insertion opening 12. Contacts 18 and 22 are selected in FIG. 2 by controlling the rotation of a mating connector as it is inserted into insertion opening 12.

Figure 3:
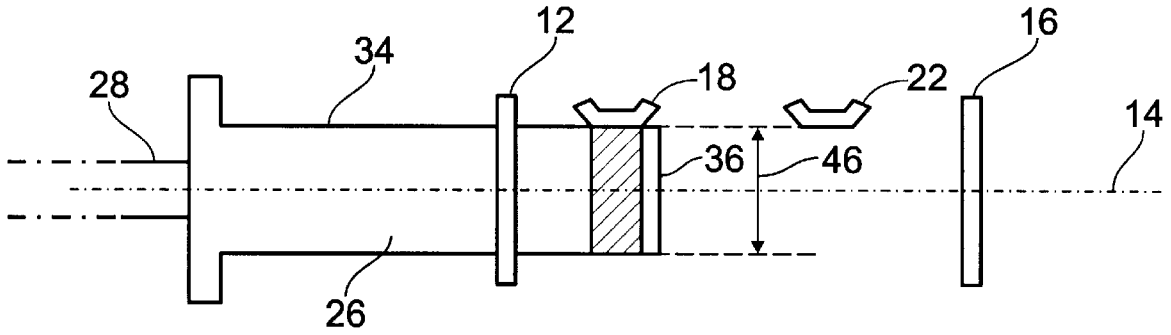
FIG. 3 illustrates an antenna connector insertable into the insertion opening along the insertion axis to electrically interface with the first contact of the connector assembly of FIG. 1.

FIG. 3 illustrates an antenna connector 26 insertable into insertion opening 12 along insertion axis 14 to electrically interface with first contact 18 of the connector assembly of FIG. 1. An antenna, or antenna element, 28 (partially shown) is attached to antenna connector 26 and operatively coupled to the connector assembly. Likewise, an antenna radiating element (not shown) is operatively coupled to first contact 18 through antenna element 28 and antenna connector 26.

Figure 4:
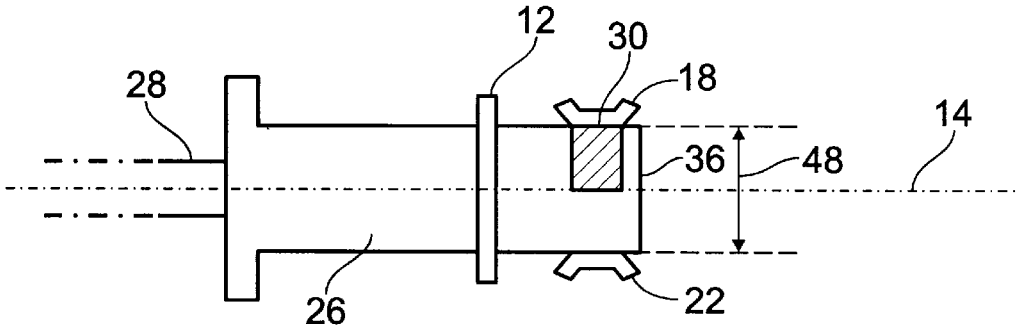
FIG. 4 illustrates an alternate embodiment of the antenna connector of FIG. 3.

FIG. 4 illustrates an alternate embodiment of antenna connector 26 of FIG. 3. Antenna connector 26 of FIG. 4 has a contact surface 30 which is suitable to interface with first contact 18, when contacts 18 and 22 are arranged as in FIG. 2. Contact surface 30 of FIG. 4 is located along only a portion of a perimeter around the axis of antenna connector 26. A groove, or other interlocking means, aligns antenna connector 26 with connector assembly body 10, and insures that contact surface 30 interfaces with first contact 18, instead of second contact 22. That is, the interface between a contact and its respective mating connector is made through controlling the rotation of the connector as it is inserted into insertion opening 12.

Figure 5:
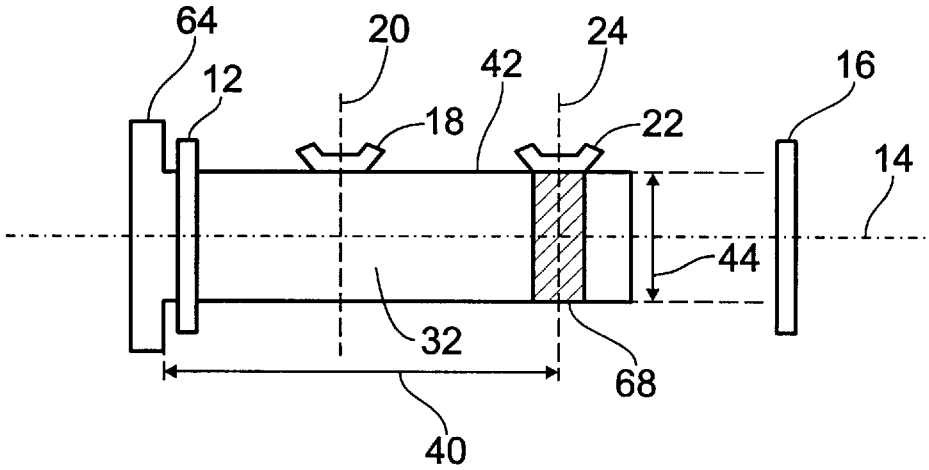
FIG. 5 illustrates a second mating connector insertable into the insertion opening along the insertion axis to interface with the second contact of the connector assembly of FIG. 1.

FIG. 5 illustrates a second mating connector 32 insertable into insertion opening 12 along insertion axis 14 to interface with second contact 22 of the connector assembly of FIG. 1. Second mating connector 32 is insertable into insertion opening 12 when antenna connector 26 is removed. Typically, second connector 32 is a coaxial test connector, or test lead, to conduct signals from second contact 22 of the connector assembly to test equipment. In this manner, a wireless device (not shown) associated with the connector assembly is tested through a calibrated communications link.

Figure 6:
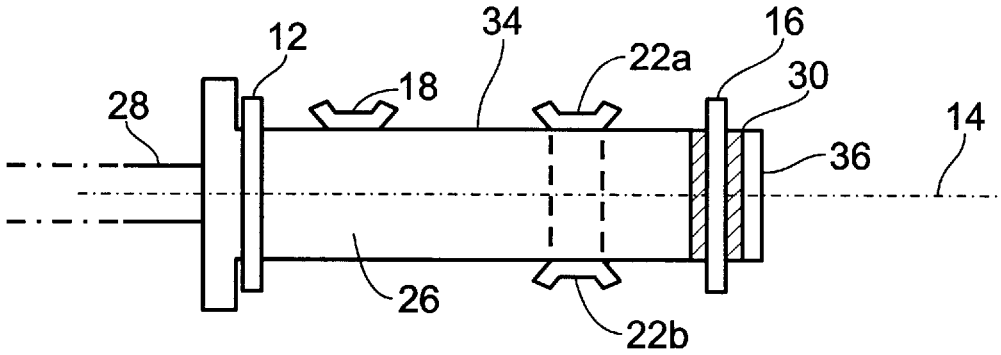
FIG. 6 illustrates the antenna connector including an antenna member elongated along an axis selectively insertable into the insertion opening, through the body, and out of the retraction opening.

FIG. 6 illustrates antenna connector 26 including an antenna member 34 elongated along an axis selectively extendible into insertion opening 12, through body 10, and out retraction opening 16. That is, antenna connector 26 passes through body 10 for storage. When antenna connector 26 is inserted into insertion opening 12 to engage the connector assembly, insertion axis 14, and the axis of elongated member 34, generally coincide. Alternately, antenna connector 26 is shaped so that at least part of antenna element 28 also extends into insertion opening 12 to reduce the profile of the antenna. In another alternative, the end of antenna connector 26 extending into insertion opening 12 is reversed so that the radiating element (not shown) and antenna element 28 are inserted into insertion opening 12, through body 10, and out retraction opening 16 for storage of the antenna. Typically, antenna connector 26 is an integral part of antenna, or antenna element, 28. Antenna 28 sometimes houses matching circuitry operatively connected to a radiating element (not shown). Antenna element 28 also houses a predetermined length of conductor used to create a predetermined impedance.

Still referring to FIG. 6, antenna elongated member 34 has a distal end 36 slideably moveable along insertion axis 14 into insertion opening 12, through body 10, and out of retraction opening 16, whereby antenna connector 26 is retractable through body 10 for storage. That is, antenna connector 26 is slid from the position shown is FIG. 3 so that distal end 36 extends from retraction opening 16 as shown in FIG. 6.

In the preferred embodiment, antenna connector 26 has a first, high gain, position when antenna distal end 36 is minimally inserted into insertion opening 12 to interface first contact 18, as shown in FIG. 3. Returning again to FIG. 6, antenna connector 26 has a second, low gain, position when antenna distal end 36 is maximally inserted into insertion opening 12, through body 10 and out of retraction opening 16, for optimum portability, whereby antenna 28 is moveable to communicate radiated signals in a plurality of antenna positions. That is, antenna connector 26 electrically interfaces with first contact 18 in at least two locations along extended member 34, as member 34 travels from the minimally to the maximally extended positions. Alternately, member 34 may interface with first contact 18 in a plurality of locations, or the entire surface of member 34 is conductive so that member 34 is continuously interfaced with first contact 18 as antenna connector 26 travels from minimum to maximum extension.

Referring to FIG. 1, the distance along insertion axis 14 between insertion opening 12 and first contact location 20 is a first distance 38. The distance between insertion opening 12 and second contact location 24 is a second distance 40, greater than first distance 38. In this manner, first 18 and second 22 contacts are selected by controlling the depth to which a mating connector is inserted into insertion opening 12. In one alternate embodiment, first contact 18 is insertion opening 12. In the preferred embodiment, first 18 and second 22 contacts are selected in response to how far the mating connector is inserted into body 10. Preferably, the conductive surfaces on antenna connector 26 interface with first contact 18, and the conductive surfaces of second connector 32 interface with second contact 22. Alternately, a single mating connector is inserted a first distance into insertion opening 12 to interface to first contact 18, and then inserted a second distance into insertion opening 12 to interface second contact 22. In this manner, a single connector can be used to interface to either one of two different signals.

The design of the present invention does not prevent the reversal of the connector order, so that antenna mating connector 26 interfaces with second contact 22, while second connector 32 mates instead with first contact 18. In this embodiment, antenna connector 26 is always inserted past first location 20 to reach and interface with second contact 22 at second location 22. When antenna 28 is retracted, elongated member 34 extends, at least partially, out retraction opening 16.

Referring again to FIG. 5, second mating connector 32 includes a member 42 elongated along an axis. When second mating connector 32 is inserted into insertion opening 12 and mated with the connector assembly, the member 42 axis and insertion axis 14 are generally aligned. Second mating connector 32 has a first diameter 44 around the axis of elongated member 42 to interface with second contact 22. Referring to FIG. 3, antenna connector 26 has a first diameter 46 around the axis of elongated number 34 to interface with first contact 18. First diameter 44 of second connector 32 is the same as first diameter 46 of antenna connector 26. Referring again to FIG. 1, contacts 18 and 22 are located along a perimeter having a second diameter 48 around insertion axis 14, with second diameter 48 being less than or equal to first diameter 44 and 46, whereby the pressure of each mating connector member 34 and 42 against its respective connector assembly contact 18 and 22 insures reliable electrical and mechanical connections.

In the preferred embodiment, first 18 and second 22 contacts interface with their respective mating connector elongated members 34 and 42 along the cylindrical sides of members 34 and 42. Typically, the connector conductive surfaces complete the circumference around members 34 and 42 so that mating connectors 26 and 32 need no rotational alignment as they inserted into insertion opening 12. Areas of members 34 and 42 which are not conductive surfaces, are preferably an insulation material. The insulated areas of members 34 and 42, preferably, have a diameter smaller than the conduction surfaces which have first diameters 44 and 46. In this manner, only connector conduction surfaces have a large enough diameter to interface with contacts 18 and 22.

First 18 and second 22 contacts have only one location along a perimeter having second diameter 48, as shown in FIGS. 1–5. Preferably, first 18 and second 22 contacts are a set of joined spring clips that are forced open, at least partially, by inserted members 34 and 42. FIG. 6 depicts second contact 22 being a set of joined contacts 22*a* and 22*b*, physically joined and carrying the same signal. The connection between contacts 22*a* and 22*b* is represented by the dotted lines running behind antenna connector 26. In another variation, contacts 18 and 22 are a ring having approximately a second diameter through which elongated members 34 and 42 are inserted. As is well known in the art, there are many other methods for interfacing conduction surfaces in a physically secure manner. Although the contact and member surfaces, mentioned above, are described in terms of circular shapes and diameters, the principles of the invention hold true for orthogonal and irregularly shaped connectors and contacts.

FIG. 7 illustrates antenna mating connector 26 including a first elongated member 50 having an opening through which the axis of first member 50 passes. The first member 50 opening has a third diameter 52 around the axis of first member 50, with third diameter 52 being less than second diameter 48. First member 50 has a first diameter 46 around the axis of first member 50 to interface with first contact 18. Antenna connector 26 also includes a second elongated number 54 with a distal end 56 having approximately a third diameter 57 around the axis of second member 54, second member 54 is extendible through the first member 50 opening to operatively interface with first contact 18 through first member 50. When antenna connector 26 is engaged with the connector assembly, the axis of first member 50 and the axis of second member 54 generally coincide with insertion axis 14. In this manner, second member distal end 56 is extendible past second contact 22, through body 10, and out retraction opening 16, without second member 54 interfacing with second contact 22. That is, the diameter of second member 54 is small enough that, as it is extended through body 10, and out retraction opening 16, it makes no contact with second contact 22, which has a larger diameter around insertion axis 14 than second member 54.

FIG. 8 illustrates a perspective view of antenna connector 26 of FIG. 7. The opening in first member 50 has a third diameter 52 around the axis of first member 50, with third diameter 52 being less than second diameter 48. First member 50 has a first diameter 46 around the axis of first member 50 to interface with first contact 18. Antenna connector 26 also includes second elongated member 54, with a distal end 56, having approximately a third diameter 57 around the axis of second member 54. When antenna connector 26 is engaged with the connector assembly, the axis of second member 54 generally coincides with the axis of first member 50 and insertion axis 14. Second member 54 is extendible through the first member 50 opening to electrically interface first member 50 to second member 54. That is, when second member 54 is extended through first member 50, there is an electrical interface between members 50 and 54. Typically, second member 54 is operatively connected to the radiating element of the antenna (not shown). The radiating element and antenna second member 54 are operatively interfaced with first contact 18 through first member 50. Referring again to FIG. 7, it can be seen that second member distal end 56 is extendible past second contact 22, through body 10, and out retraction opening 16, without second member 54 interfacing with second contact 22. Approximate third diameter 57 is close enough in size to the third diameter 52 opening to insure a secure electrical interface, while still allowing second member 54 to move through the opening. Depending on the shapes of elongated members 50 and 54, conduction surfaces, and contacts 18 and 22, the tolerance between the first member 50 hole and member 54 varies.

In the preferred embodiment of the invention, second elongated member 54 has a plurality of conductive surfaces located along approximately third diameter 57 around the axis of second member 54. FIG. 7 depicts at least two such conductive surfaces, 58 and 60. Alternately, there may be more than 2 conductive surfaces on second member 54, or the entire surface of member 54 is conductive so that the antenna radiates regardless of the position of second member 54. Second member 54 is slideably moveable through the first member 50 opening to be operatively connected to first contact 18 in a plurality of positions. Conductive surfaces 58 and 60 are operatively interfaced to first contact 18, when either conduction surface 58 or 60 engages first member 50. Second member 54 extends from a wireless device associated with the connector assembly to obtain optimal antenna gain. That is, antenna connector 26 is extendible for maximum antenna gain when second member distal end 56 is minimally inserted into insertion opening 12. For maximum antenna gain, conduction surface 58 interfaces with first member 50. Antenna connector 26 is retracted for low profile, low gain, operation when distal end 56 maximally inserted into insertion opening 12, through body 10, and out retraction opening 16. That is, conduction surface 60 interfaces with first member 50.

Antenna connector 26 has a flange 62 to limit the penetration of antenna connector 26 into insertion opening 12 when engaged with the connector assembly. Likewise, referring to FIG. 5, second mating connector 32 has a flange 64 to limit the penetration of mating connector 32 into insertion opening 12 when engaged with the connector assembly. As is well known in the art, there are several methods of controlling the depth to which a mating connector is inserted into a connector assembly. In one embodiment (not shown), insertion opening 12 has a threaded first diameter 46 around the insertion axis 14 to accept threaded mating connectors 26 and 32, with the threading determining the depth of connector penetration into body 10.

Referring again to FIG. 7, antenna connector 26 has a conductive surface 66 located approximately a first distance 38 along the axis of elongated member 50 from flange 62 to interface with first contact 18. Referring again to FIG. 5, second mating connector 32 has a conductive surface 68 located approximately a second distance 40 along the axis of elongated member 42 from flange 64 to interface with second contact 22. In this manner, contact 18 and 22 are selected in response to the penetration of member conduction surfaces 66 and 68 into connector assembly body 10. That is, connectors 26 and 32 are designed to mate with only one contact of the connector assembly. The contact selected is determined by the distance of the connector conduction surface from the flange. There are many other known methods for controlling the insertion depth of conduction surfaces 66 and 68.

Still referring to FIG. 7, in one embodiment of the invention, antenna first member 50 has a fourth diameter (not shown) around the axis of first member 50, with the fourth diameter being greater than first diameter 46. In this same embodiment, first contact 18 is located along a perimeter having a fifth diameter (not shown) around insertion axis 14, with the fifth diameter being greater than second diameter 48, but less than or equal to the fourth diameter. That is, the diameter of antenna connector 26 is larger than the diameter of second mating connector 32, and first contact 18 is along a perimeter having a larger diameter than second diameter 48. In this manner, second connector 32 is insertable into insertion opening 12, past first contact 18, without interfacing with first contact 18 during the act of insertion. Antenna connector 26 does not short, or contact, to second contact 22 because the depth of its penetration into body 10 is limited to approximately first distance 38. When first contact 18 and second contact 22 are both located along a perimeter having second diameter 48, second connector 32 momentarily shorts against first contact 18 before it reaches second contact 22. In the above mentioned embodiment, second mating connector 32 does not short, or contact, to first contact 18 because its diameter is not large enough to engage first contact 18. Using this embodiment, a switch to disconnect the unused contact, or load insensitive circuitry, is not required to prevent the potentially harmful effects of unintentional shorting during the connector mating process.

Figure 9:
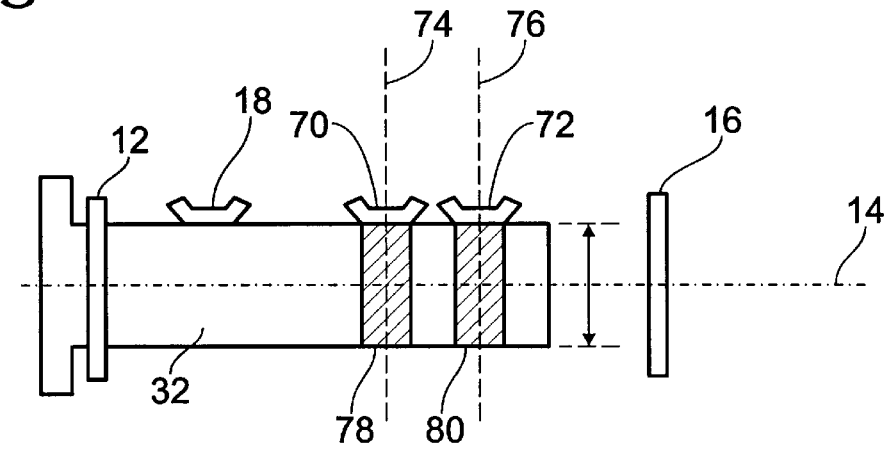
FIG. 9 illustrates an embodiment of the invention where the second contact is a pair of contacts to communicate a differential signal.

FIG. 9 illustrates an embodiment of the invention where second contact 22 is a pair of contacts to communicate a differential signal. That is, second contact 22 is a pair of contacts including a third 70 and a fourth 72 contact respectively positioned adjacent a third 74 and fourth 76 location on insertion axis 14 between insertion opening 12 and retraction opening 16. Third and fourth locations 74 and 76 are typically a third and fourth distance (not shown) along the insertion axis from insertion opening 12, with the third and fourth distances both being greater than first distance 38. Second mating connector 32 includes a pair of conduction surfaces 78 and 80 to interface with second contact pair 70 and 72 when second mating connector 32 is engaged with the connector assembly. The conductive surfaces are insertable approximately a third and fourth distance into insertion opening 12.

Alternately, first contact 18 may be a pair of contacts to interface with antenna connector 26 having a pair of conduction surfaces. In the same manner, both first 18 and second 22 contacts are contact pairs in some variations of the invention. Some antenna designs require a ground, or reference, to accompany the signal to be radiated into the antenna from the connector assembly. These designs require a contact pair to connect the antenna to the connector assembly. Other antenna designs rely on the case ground for reference, and only the signal to be radiated is conducted into the antenna. Typical conducted test signals require a ground reference so that second contact 22 is almost always a contact pair.

Figure 10:
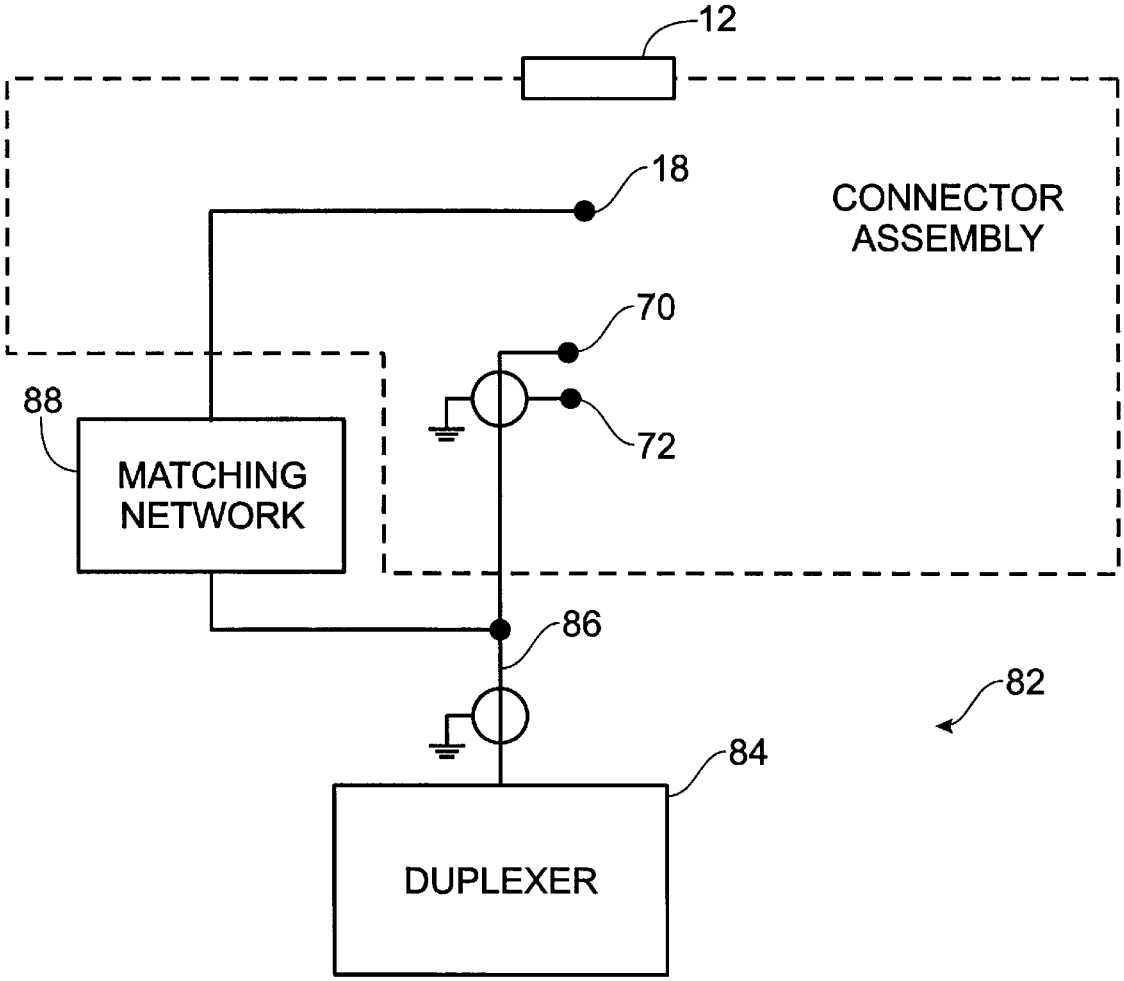
FIG. 10 is a schematic diagram illustrating a typical application of the present invention in a portable wireless device.

FIG. 10 is a schematic diagram illustrating a typical application of the connector assembly of the present invention in a portable wireless device. A typical wireless device 82 includes a duplexer 84 to send and receive communicated information on a conductive line 86. The electrical signal on line 86 has an impedance with respect to ground, typically that impedance is 50 ohms. Some systems use other impedances, but the principles of the invention, described herein, still apply. In a typical application of the connector assembly of the present invention, the signal of line 86 and its relative ground are interfaced with contact pair 70 and 72. When mated with second connector 32 (not shown), the signal on line 86 is carried away on a coaxial cable to test equipment having a predetermined impedance which matches the impedance of duplexer 84. In this manner, wireless device 82 can be tested over a calibrated link before shipment. A stimulus from the test equipment (not shown) can be applied through the coaxial cable to contacts 70 and 72, and ultimately to wireless device 82. The return response of wireless device 82, through contacts 70 and 72, back to the test equipment verifies that device 82 is operational. After test, antenna connector 26 (not shown) is interfaced with first contact 18. Since a typical antenna does not have the same impedance as standard test equipment, a matching network 88 is needed to transform impedances. That is, when antenna connector 26 is attached, signals to be radiated are conducted along line 86 through network 88 to first contact 18, and ultimately to antenna 28 where they are radiated. Received radiated signals are processed in the reverse order.

An antenna signal on first contact 18 has a first impedance to match the impedance of the antenna, and a signal between second contact pair 70 and 72 has a predetermined, second, impedance to interface, through second mating connector 32, with the predetermined impedance of test equipment. In the preferred embodiment, the predetermined impedance is 50 ohms, whereby the connector assembly is interfaced, through second mating connector 32, to standard test equipment.

Figure 11:
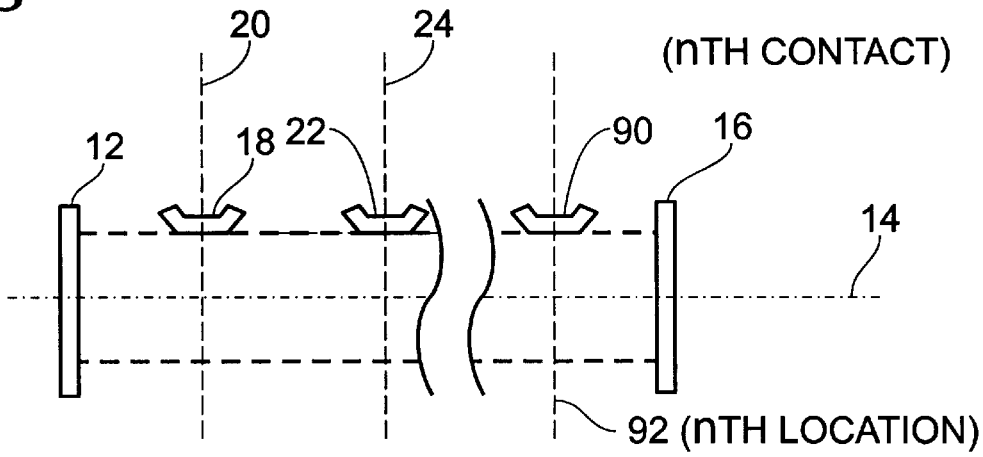
FIG. 11 illustrates an alternate embodiment of the invention in which the first and second contacts are a plurality of contacts.

FIG. 11 illustrates an alternate embodiment of the invention in which first 18 and second 22 contacts are a plurality of n contacts. FIG. 11 is similar to FIG. 1 except that a larger number of contacts are depicted. That is, instead of two contacts, there are n number of contacts. The n contacts are adjacent a plurality of n location along insertion axis 14 between insertion opening 12 and retraction opening 16.

FIG. 11 depicts an nth contact 90 at an nth location 92. There are at least three contacts associated with the connector assembly, with any number of contacts between second contact 22 and nth contact 90. Likewise, mating connectors 26 and 32 are a plurality of n connectors. Each nth connector interfaces with its corresponding nth contact when extended into insertion opening 12 to mate with the connector assembly. That is, antenna connector 26 interfaces with first contact 18, second connector 32 interfaces with second contact 22, and an nth connector interfaces with nth connector 90. In this manner, the connector assembly is selectively engageable to communicate through one of many electrical contacts, with the selection of each contact being make in response to mating said connectors to the connector assembly.

This embodiment of the connector assembly still allows antenna connector 26 to mate with first contact 18 after test. During test, second connector 32 mates with second contact 22 to complete a calibrated RF link. An nth connector is mated to nth contact 90, for example, to test logic functions or to load memory. Typically, each contact, except perhaps first contact 18, is a contact pair to conduct a reference ground along with the signal of interest. Likewise, each corresponding connector has conduction surface pairs to interface with the contact pairs. Antenna connector 26 is still retractable. In some configurations, distal end 56 still extends out retraction opening 16 is positioned along insertion axis 14 further from insertion opening 12 than nth location 92. Alternately, retraction opening 16 is positioned along insertion axis 14 past second contact 22, or some other contact, between second contact 22 and nth contact 90.

Figure 12:
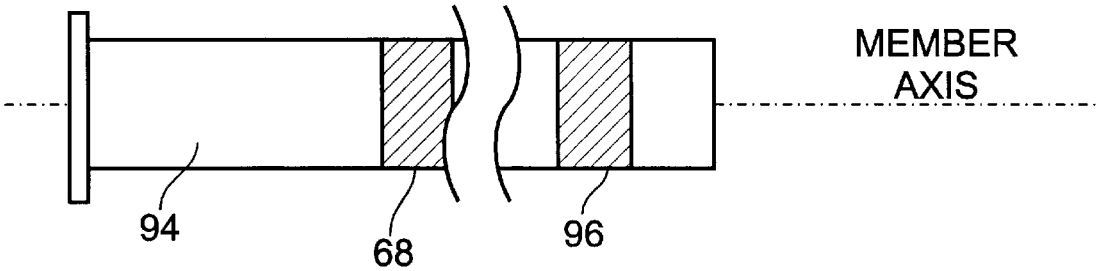
FIG. 12 is a mating connector with a plurality of conduction surfaces to interface the plurality of contacts depicted in the connector assembly of FIG. 11.

FIG. 12 is a mating connector with a plurality of conduction surfaces to interface the plurality of contacts of FIG. 11. In one embodiment of the invention, one of the plurality of n mating connectors has a plurality of m conduction surfaces, with m being less than or equal to n, to interface simultaneously with a plurality of m contacts, and simultaneously communicate a plurality of m signals, whereby many signals are communicated between the mating connector and the connector assembly. A mating connector 94 engages the connector assembly to electrically interface conduction surface 68 with second contact 22 (FIG. 11), as well as conduction surface 96 with nth contact 90 (FIG. 11). Connector 94 potentially has any number of conduction surfaces between surfaces 68 and 96 corresponding to contacts between second contact 22 and nth contact 90 in FIG. 11. Such a scheme still allows antenna connector 26 to interface with first contact 18 after test, and to be retractable. During test, mating connector 94 interfaces with second contact 22 to conduct transmit and receive signals from wireless device 82 to the test equipment. At the same time, connector 94 interfaces to nth contact 90 to, for example, bring out information from the logic section of wireless device 82 to aid in trouble-shooting and repairs. Typically, each contact will be a contact pair to communicate a differential signal, requiring connector 94 to have conduction surface pairs interfacing respectively with corresponding contact pairs.

Figure 13:
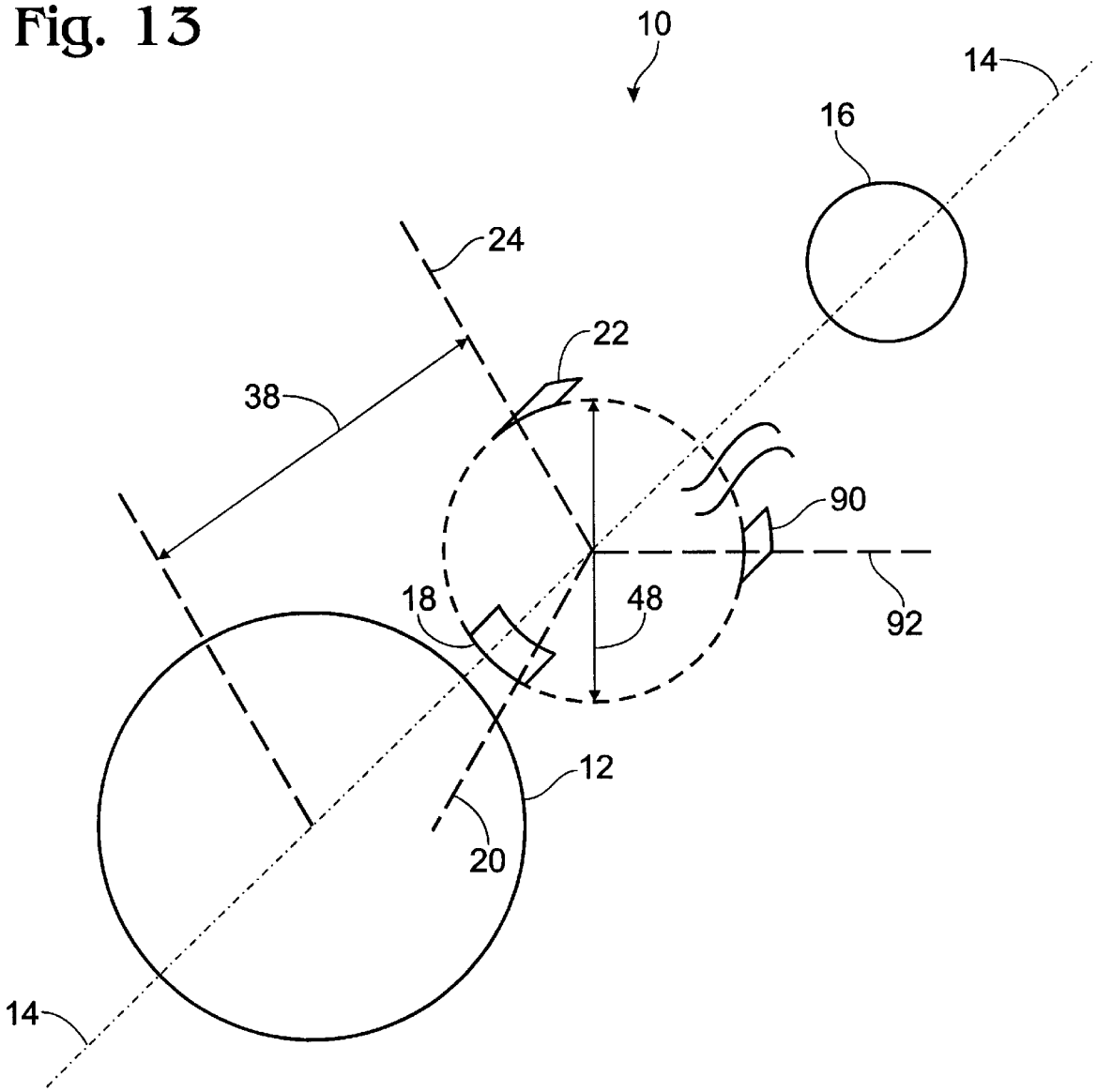
FIG. 13 illustrates an alternate embodiment of the n contact connector assembly of FIG. 11.

FIG. 13 illustrates an alternative embodiment of the n contact connector assembly of FIG. 11. The contact arrangement depicted in FIG. 13 is similar to the contact arrangement depicted in FIG. 2. First contact 18, second contact 22, and nth contact 90, are positioned adjacent locations along insertion axis 14 in connector assembly body 10 along a perimeter having second diameter 48 around insertion axis 14. Any number of contacts can be located between second contact 22 and nth contact 90 along the perimeter. First contact 18 is at a first location 20, second contact 22 is at a second location 24 and nth contact 90 is at an nth location 92 on the perimeter. All locations are a first distance 38 from insertion opening 12. A mating connector (not shown) selectively interfaces with one of the n contacts. Alternately, the mating connector selectively interfaces with more than one contact, the same design concept as depicted in FIG. 11. A groove, or key, to interlock the mating connector and connector assembly body 10 ensures that the mating connector can only be inserted one way to interact with the intended contact. As above, antenna connector 26 interfacing with first contact 18, is slideably moveable so that it retracts, at least partially, through retraction opening 16. Typically, many of the contacts are contact pairs so that the mating connector has conduction surface pairs respectively interfacing with its corresponding contact pair.

Figure 14:
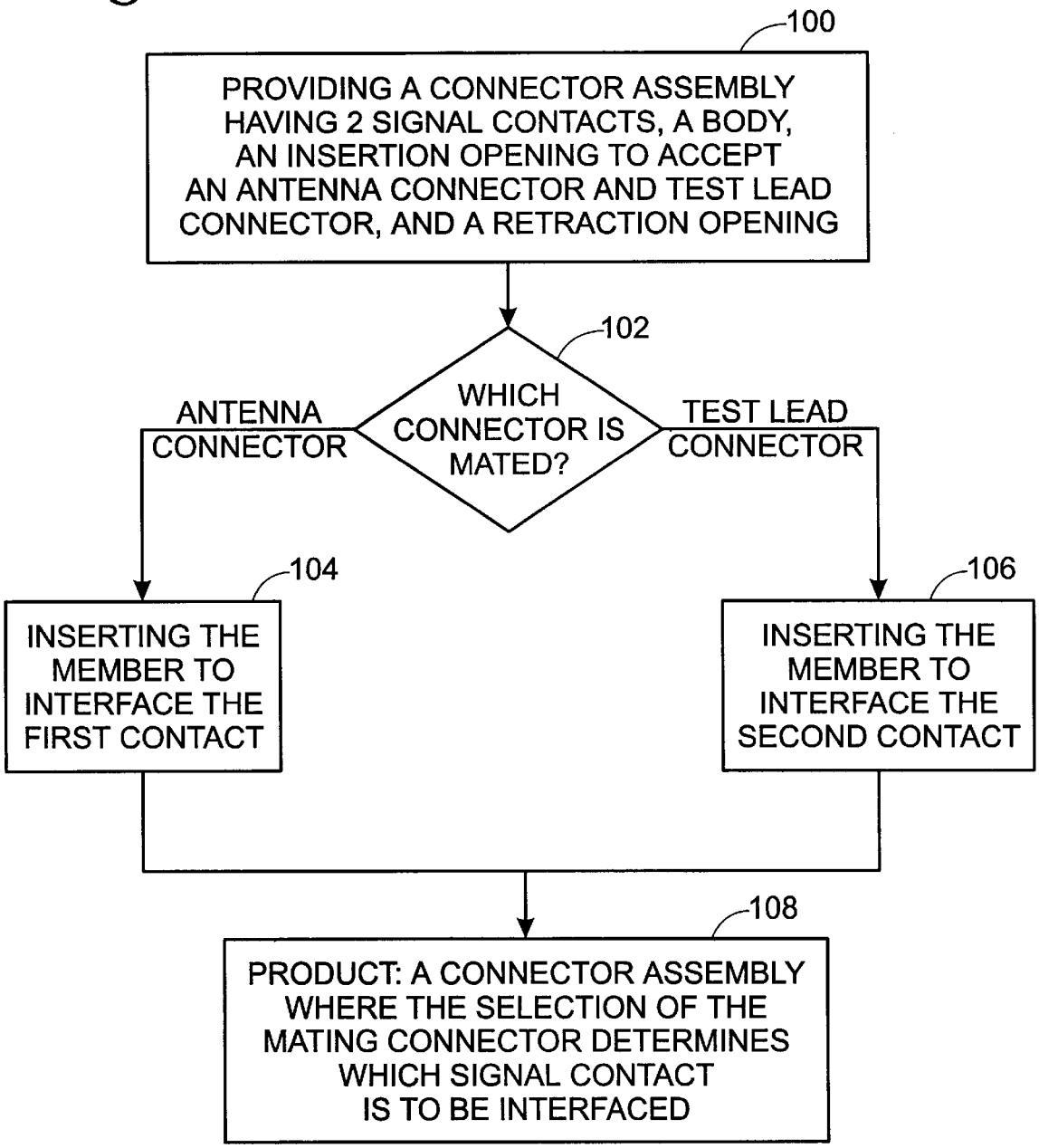
FIG. 14 illustrates steps in the method for selectively communicating electrical signals from a connector assembly having two signal contacts.

FIG. 14 illustrates steps in the method for selectively communicating electrical signals from a connector assembly having two signal contacts. Step 100 provides two signal contacts in a connector assembly body, the body includes an insertion opening, through which the insertion axis passes, to allow access to the signal contacts from an antenna mating connector having a member elongated along an axis, and a test lead, or second, mating connector having a member elongated along an axis. The body also includes a retraction opening at the end opposite the insertion opening along the insertion axis to allow the passage of a connector member extending through the body.

Step 102 determines which connector is mated to the connector assembly. When the antenna connector is mated to communicate a radiated signal, Step 104 inserts the antenna connector elongated member through the insertion opening to interface with a first signal contact adjacent a first location along the insertion axis between the insertion opening and the retraction opening. When the test lead connector is mated to conduct a signal, Step 106 inserts the test lead connector elongated member through the insertion opening to interface with a second signal contact adjacent a second location along the insertion axis between the insertion opening and the retraction opening.

Step 108 is a product, a connector assembly where the selection of a mating connector determines which signal contact is interfaced. The method includes the further Step of, when the antenna connector is to mated to the connector assembly and no signals are to be radiated, inserting the antenna connector elongated member through the insertion opening along the insertion axis, extending the member through the body, and out the retraction opening, whereby the antenna profile is reduced for storage.

The first location is closer to the insertion opening than the second location, and Step 106 includes inserting the elongated member of the test lead mating connector into the insertion opening, past the first contact, to reach and interface the second contact, whereby a signal contact is selected in response to the depth to which a mating connector is inserted into the connector assembly.

In the preferred embodiment, the antenna elongated member has a distal end and a plurality of first contact interface positions on the member. Step 104 includes communicating a radiated signal with a relatively high gain antenna position, and includes slideably moving the elongated member to interface with the first signal contact so that the distal end is minimally inserted into the insertion opening. Further, an additional Step is included of, when the antenna connector is mated to communicate a radiated a signal with a low profile antenna, slideably moving the distal end into the insertion opening along the insertion axis, through the connector assembly body, and out the retraction opening, to interface with the first contact, whereby the distal end is maximally inserted through the insertion opening to radiate in an antenna position optimal for portability.

Each connector elongated member has a first diameter around the axis of the elongated member. The first and second contacts are located along a perimeter having a second diameter around the insertion axis, with the second diameter less than or equal to the first diameter. Step 104, and the additional step of selecting the low profile antenna position, include inserting the antenna connector elongated member along the insertion axis to engage the first contact. Step 106 includes inserting the test lead connector elongated member to engage the second contact, whereby the electrical connection is made secure by the tension between the contacts and connector surfaces.

In the preferred embodiment, the antenna mating connector includes a first elongated member having a opening through which the member axis passes, the first member opening having a third diameter, with the third diameter being less than the second diameter. The first member has a first diameter around the axis of the first member to interface with the first contact. The antenna mating connector also includes a second elongated member having approximately a third diameter around the axis of the second member, the second member being extendible through the first member opening to electrically interface the first member to the second member. Then, Step 104 (communicating a radiated signals with a relatively high gain antenna position) includes inserting the first member into the insertion opening to interface the first member with the first signal contact, minimally inserting the second member into the insertion opening to operatively connect the second member with the first contact. The additional Step includes inserting the first member into the insertion opening to interface the first member with the first signal contact, extending the second member through the body, and out the retraction opening, whereby the antenna second, extending, member is moveable past the second signal contact to change antenna length without interfacing the second contact.

Preferably, the second member is slideably moveable through the first member opening. Then Step 104 also includes sliding the second member, minimally inserting the second member into the insertion opening, to operatively connect the second member with the first contact. The additional Step, then includes sliding the second member, maximally inserting the second member into the insertion opening, to operatively connect the second member with the first contact, whereby the antenna is able to radiate in a positions optimal to portability and gain.

In the preferred embodiment, the first location is a first distance along the insertion axis from the insertion opening, and the second location is a second distance, greater than the first, along the insertion axis from the insertion opening. Then, Step 104 includes inserting the antenna first member approximately a first distance into the insertion opening to interface with the first contact. Step 106 includes inserting the test lead member approximately a second distance into the insertion opening to interface with the second contact, whereby the mating connectors are differentiated by the depth of insertion into the insertion opening.

The connector assembly second signal contact is, typically, a pair of contacts to communicate a differential signal, and the test lead mating connector includes a pair of conduction surfaces to interface with the second contact pair. Then, Step 106 includes inserting the test lead mating connector into the insertion opening along the insertion axis to interface the connector conduction surface pair with the second contact pair, whereby the test lead conducts a differential signal when engaged with the connector assembly.

A first signal on the first contact is an antenna signal having an impedance to match an antenna impedance. A second signal on the second contact pair is a test signal having a predetermined impedance between the pair of contacts to match the impedance of the test lead connector.

The connector assembly of the present invention uniquely solves many problems involved in troubleshooting and testing a portable wireless device before shipment or during a repair. The connector assembly permits either an antenna, or a coaxial cable to be attached to the wireless device. The use of only a single opening, or port, to access the assembly reduces the parts count of the unit, and reduces the number of interfaces on a device having critical size limitations. Since the connectors are co-located, there is also less internal wiring which often increases the insertion loss through at least one of the ports in a two port device. Minimizing insertion loss in the communication link is critical in portable units that often have marginal communication links. Insertion loss is also critical because the device power is typically from a small battery. Even in units designed to minimize loss to the antenna port, insertion loss variations in the port leading to the test equipment will lead to improper calibration and test of the unit.

The connector assembly of the present invention also permits an associated antenna to be retracted into the assembly, and through the assembly body, for storage or low gain standby operation. Thus, the present invention combines attributes of a single port antenna connector that can be used to engage cables for test, while still allowing to antenna to be retracted. In an alternate embodiment of the invention, a test connector is mated with a wireless device using the connector assembly of the present invention to simultaneously communicate a number of test signals. In this manner, baseband and logic portions of the device can be checked in response to a RF signal hardlined to the device. All these signals are communicated simultaneously through the same connector port. Because of the parsimony of the design, the production costs of these connector assemblies and associated mating connectors are very modest. Other embodiments of the invention will occur to those skilled in the art.

What is claimed is:

1. An electrical connector assembly selectively engageable with mating connectors along a common insertion axis, the connector assembly comprising:

a connector assembly body into which mating connectors are inserted, said body including an insertion opening through which the insertion axis passes, said body including a retraction opening at the end opposite said insertion opening along the insertion axis to permit passage of a mating connector member through said connector assembly body;

a first contact positioned adjacent a first location along the insertion axis in said connector assembly body between said insertion opening and said retraction opening;

an antenna connector insertable into said insertion opening along the insertion axis to electrically interface with said first contact, whereby an antenna is operatively coupled to the connector assembly;

a second contact positioned adjacent a second location in said connector assembly body along the insertion axis between said insertion opening and said retraction opening;

a second mating connector insertable into said insertion opening along the insertion axis to interface with said second contact, whereby said second mating connector is insertable into said insertion opening when said antenna connector is removed; and said antenna connector including an antenna member elongated along an axis selectively extendible into said insertion opening, through said body, and out of said retraction opening, whereby said antenna connector passes through said body for storage.

2. A connector assembly as in claim 1 in which said antenna elongated member has a distal end slideably moveable along the insertion axis into said insertion opening, through said body, and out of said retraction opening, whereby said antenna connector is retractable through said body for storage.

3. A connector assembly as in claim 2 in which said antenna connector has a first, high gain, position when said antenna distal end is minimally inserted into said insertion opening to interface said first contact, and a second, low gain, position when said antenna distal end is maximally inserted into said insertion opening, through said body, and out of said retraction opening, for optimal portability, whereby said antenna is moveable to communicate radiated signals in a plurality of positions.

4. A connector assembly as in claim 3 in which the distance along the insertion axis between said insertion opening and said first contact location is a first distance, and the distance between said insertion opening and said second contact location is a second distance, greater than the first distance, whereby said first and second contacts are selected by controlling the depth to which a mating connector is inserted into the insertion opening.

5. A connector assembly as in claim 4 in which said second mating connector includes a member elongated along an axis, in which each said mating connector has a first diameter around the axis of each said elongated member to interface with said contacts, and in which each said contact is located along a perimeter having a second diameter around the insertion axis, with the second diameter being less than or equal to the first diameter, whereby the pressure of each said mating connector member against its respective connector assembly contact insures reliable electrical and mechanical connections.

6. A connector assembly as in claim 5 in which said antenna mating connector includes a first elongated member having an opening through which said first member axis passes, said first member opening having a third diameter around the axis of said first member, with the third diameter being less than the second diameter, said first member having a first diameter around the axis of said first member to interface with the first contact, in which said antenna connector also includes a second elongated member, with a distal end, having approximately a third diameter around the axis of said second member, said second member extendible through said first member opening to operatively interface with said first contact through said first member, whereby said second member distal end is extendible past said second contact, through the body, and out the retraction opening, without said second member interfacing with said second contact.

7. A connector assembly as in claim 6 in which said second elongated member has a plurality of conductive surfaces located along approximately a third diameter around the axis of said second member, and in which said second member is slidably moveable through said first member opening to be operatively connected to said first contact in a plurality of positions, whereby said antenna connector is extendible for maximum antenna gain when said second member distal end is minimally inserted into said insertion opening, and retractable for low profile, low gain, operation when said distal end is maximally inserted into said insertion opening, through said body, and out of said retraction opening.

8. A connector assembly as in claim 6 in which each said mating connector has a flange to limit the penetration of said mating connector into said insertion opening when engaged with the connector assembly, in which said antenna connector has a conductive surface located approximately a first distance along the axis of said elongated member from said flange to interface with said first contact, and in which said second mating connector has a conductive surface located approximately a second distance along the axis of said elongated member from said flange to interface with said second contact, whereby said contacts are selected in response to the penetration of said member conduction surfaces into said connector assembly body.

9. A connector assembly as in claim 6 in which said antenna first member has a fourth diameter around the axis of said first member, with the fourth diameter being greater than the first diameter, and said first contact is located along a perimeter having a fifth diameter around the insertion axis, with the fifth diameter being greater than the second diameter but less than or equal to the fourth diameter, whereby said second connector is insertable into said insertion opening, past said first contact, without interfacing with said first contact during the act of insertion.

10. A connector assembly as in claim 1 in which said second contact is pair of contacts including a third and fourth contact respectively positioned adjacent a third and fourth location on the insertion axis between said insertion opening and the retraction opening, and in which said second mating connector includes a pair of conduction surfaces to interface with said second contact pair when said second mating connector is engaged with the connector assembly.

11. A connector assembly as in claim 10 in which an antenna signal on said first contact has a first impedance to match the impedance of said antenna, and in which a signal between said second contact pair has a predetermined, second, impedance to interface, through said second mating connector, with the predetermined impedance of test equipment.

12. A connector assembly as in claim 11 in which the predetermined impedance is 50 ohms, whereby the connector assembly is interfaced, through said second mating connector, to standard test equipment.

13. A connector assembly as in claim 1 in which said first and second contacts are a plurality of n contacts adjacent a plurality of n locations along the insertion axis between the insertion opening and the retraction opening, in which said mating connectors are a plurality of n connectors, and in which each said nth connector interfaces with its corresponding nth contact when extended into said insertion opening to mate with the connector assembly, whereby the connector assembly is selectively engageable to communicate through one of many electrical contacts, with the selection of each said contact being made in response to mating said connectors to the connector assembly.

14. A connector assembly as in claim 13 in which one of said plurality of n mating connectors has a plurality of m conduction surfaces, with m being less than or equal to n, to interface simultaneously with a plurality of m contacts, and simultaneously communicate a plurality of m signals, whereby many signals are communicated between said mating connector and the connector assembly.

15. A method for selectively communicating electrical signals from a connector assembly having two signal contacts in a connector assembly body, the body including an insertion opening, through which the insertion axis passes, to allow access to the signal contacts from an antenna mating connector having a member elongated along an axis, and a test lead mating connector having a member elongated along an axis, the body also includes a retraction opening at the end opposite the insertion opening along the insertion axis to allow the passage of a connector member extending through the body, the method including the steps of:

a) when the antenna connector is mated to communicate a radiated signal, inserting the antenna connector elongated member through the insertion opening to interface with a first signal contact adjacent a first location along the insertion axis between the insertion opening and the retraction opening; and b) when the test lead connector is mated to conduct a signal, inserting the test lead connector elongated member through the insertion opening to interface with a second signal contact adjacent a second location along the insertion axis between the insertion opening and the retraction opening, whereby the selection of a mating connector determines which signal contact is interfaced.

16. A method as in claim 15 including the further step of:

c) when the antenna connector is mated to the connector assembly and no radiated signals are to be communicated, inserting the elongated member through the insertion opening along the insertion axis, extending the member through the body, and out the retraction opening, whereby the antenna profile is reduced for storage.

17. A method as in claim 15 in which the first location is closer to the insertion opening than the second location, and in which step b) includes inserting the elongated member of the test lead mating connector into the insertion opening, past the first contact, to reach and interface the second contact, whereby a signal contact is selected in response to the depth to which a mating connector is inserted into the connector assembly.

18. A method as in claim 15 in which the antenna elongated member has distal end and a plurality of first contact interface positions on the member, in which step a) includes communicating a radiated a signal with a relatively high gain antenna position and also includes slidably moving the elongated member to interface with the first signal contact so that the distal end is minimally inserted into the insertion opening, and including the further step of:

c) when the antenna connector is mated to communicate a radiated signal with a low profile antenna, slideably moving the distal end into the insertion opening along the insertion axis, through the connector assembly body, and out the retraction opening, to interface with the first contact, whereby the distal end is maximally inserted through the insertion opening to radiate in an antenna position optimal for portability.

19. A method as in claim 18 in which each connector elongated member has a first diameter around the axis of the elongated member, in which the first and second contacts are located along a perimeter having a second diameter around the insertion axis, with the second diameter less than or equal to the first diameter, in which steps a) and c) include the inserting the antenna connector elongated member along the insertion axis to engage the first contact, and in which step b) includes the inserting the test lead connector elongated member to engage the second contact, whereby the electrical connection is made secure by the tension between the contacts and connector surfaces.

20. A method as in claim 19 in which the antenna mating connector includes a first elongated member having an opening through which the member axis passes, the first member opening having a third diameter, with the third diameter being less than the second diameter, the first member having a first diameter around the axis of the first member to interface with the first contact, in which the antenna mating connector also includes a second elongated member having approximately a third diameter around axis of the second member, the second member being extendible through the first member opening to electrically interface the first member to the second member, in which step a) includes inserting the first member into the insertion opening to interface the first member with the first signal contact, minimally inserting the second member into the insertion opening to operatively connect the second member with the first contact, and in which step c) includes inserting the first member into the insertion opening to interface the first member with the first signal contact, extending the second member through the body, and out the retraction opening, whereby the antenna's second, extending, member is moveable past the second signal contact to change antenna length without interfacing the second contact.

21. A method as in claim 20 in which the second member is slidably moveable through the first member opening, in which step a) includes sliding the second member, minimally inserting the second member into the insertion opening to operatively connect the second member with the first contact, and in which step c) includes sliding the second member, maximally inserting the second member into the insertion opening to operatively connect the second member with the first contact, whereby the antenna is able to radiate in positions optimal for portability and gain.

22. A method as in claim 21 in which the first location is a first distance along the insertion axis from the insertion opening, and the second location is a second distance, greater than the first, along the insertion axis from the insertion opening, in which step a) includes inserting the antenna first member approximately a first distance into the insertion opening to interface with the first contact, and in which step b) includes inserting the test lead member approximately a second distance into the insertion opening to interface with the second contact, whereby the mating connectors are differentiated by the depth of insertion into the insertion opening.

23. A method as in claim 15 in which the connector assembly second signal contact is a pair of contacts to communicate a differential signal, and the test lead mating connector includes a pair of conduction surfaces to interface with the second contact pair, and in which step b) includes inserting the test lead mating connector into the insertion opening along the insertion axis to interface the connector conduction surface pair with the second contact pair, whereby the test lead conducts a differential signal when engaged with the connector assembly.

24. A method as in claim 23 in which a first signal on the first contact is an antenna signal having an impedance to match an antenna impedance, and in which a second signal on the second contact pair is a test signal having a predetermined impedance between the pair of contacts to match the impedance of the test lead connector.

25. In a wireless communications device, a connector assembly having an insertion axis along which mating connectors are selectively engaged, the connector assembly comprising:

a connector assembly body into which mating connectors are inserted, said body including an insertion opening through which the insertion axis passes, said body including a retraction opening at the end opposite said insertion opening along the insertion axis to permit passage of a mating connector member through said connector assembly body;

a first contact positioned adjacent a first location along the insertion axis in said body between said insertion opening and said retraction opening, a first distance from said insertion opening, said first contact positioned along a perimeter having a second diameter around the insertion axis, with the second diameter being less than a first diameter;

an antenna connector to electrically interface with said first contact, said antenna connector including a first member elongated along an axis with an opening having a third diameter through which said first member axis passes, with the third diameter being less than the second diameter, said first member having a first diameter around the axis of the said member to interface with said first contact, said antenna connector also including a second member elongated along an axis, with a distal end, having approximately a third diameter around said second member axis, said second member being slidably moveable through said first member opening to electrically interface said first member to said second member, said second member extending from the wireless device for optimal antenna gain when said second member distal end is minimally inserted into the connector assembly, and said second member distal end inserted into said insertion opening, through said body, and out said retraction opening for device portability when said second member is maximally inserted into the connector assembly;

a second electrical contact pair including a third and fourth contact respectively positioned adjacent a third and fourth location along the insertion axis in said body between said insertion opening and said retraction opening, said third and fourth locations being, respectively, a third and fourth distance, both greater than the first, from said insertion opening, said second contact pair positioned along a perimeter having a second diameter around the insertion axis, with said second diameter being less than or equal to the first diameter; and a second connector to electrically interface with said second contact pair, said second connector having a member along an elongated axis with a pair of conductive surfaces along a first diameter around said member axis, said conductive surfaces being insertable approximately a third and fourth distance into said insertion opening, so that said conductive surface pair interfaces with said second contact pair, whereby said second connector carries a differential signal to test the wireless device when said second connection is engaged to the connector assembly, and said antenna connector is not engaged with the connector assembly.

* * * * *